United States Patent [19]

Boughten

[11] Patent Number: 4,989,270

[45] Date of Patent: Feb. 5, 1991

[54] CONVERTIBLE CAP

[76] Inventor: Larry R. Boughten, 13680 N. Lynch Rd., Hugo, Minn. 55038

[21] Appl. No.: 384,558

[22] Filed: Jul. 24, 1989

[51] Int. Cl.[5] ..... A42C 5/04

[52] U.S. Cl. ..... 2/171.7; 2/171.5; 2/199; 2/209.1

[58] Field of Search ..... 2/190, 195, 197, 199, 2/198, 171.4, 171.5, 171.7

[56] References Cited

U.S. PATENT DOCUMENTS

| | | | |
|---|---|---|---|
| 59,092 | 10/1866 | Stattmann et al. | 2/195 |
| 1,105,400 | 7/1914 | Burke | 2/195 X |
| 1,486,102 | 3/1924 | Menton . | |
| 1,625,670 | 4/1927 | Maxwell | 2/171.5 |
| 1,648,551 | 11/1927 | Klein | 2/195 |
| 2,349,471 | 5/1944 | Starbeck | 2/176 |
| 2,870,449 | 0/1951 | Bailey . | |

*Primary Examiner*—Paul T. Sewell

*Assistant Examiner*—Beth Anne Cicconi

*Attorney, Agent, or Firm*—James V. Harmon

[57] ABSTRACT

A convertible cap is described that includes a dome-shaped crown having a front portion formed from cloth and a rear portion formed from a soft, flexible open-woven mesh to facilitate air transfer through the cap. A visor is attached to the front of the crown and extends outwardly. A movable divider formed from flexible sheet material is positioned inside the cap and is joined to the inside of the crown along an arcuate transversely extending line of attachment which serves as a fold line. The divider is adapted to be deflected rearwardly to a position conforming to the inside of the mesh during cool or inclement weather or forwardly to allow air to pass through the mesh. A pliant headband at the lower edge of the divider is formed from soft supple material adapted to conform comfortably the contour of the head.

12 Claims, 2 Drawing Sheets

CONVERTIBLE CAP

FIELD OF THE INVENTION

The present invention relates to articles of clothing and more particularly to a cap which can be converted to accommodate changes in the weather.

BACKGROUND OF THE INVENTION

Baseball style caps are a very popular item. Caps of this type can be made more comfortable in hot weather by being formed in part from an open meshwork. Such a cap will, however, be uncomfortable in rain or cold weather because of its open structure. Other baseball style caps now in common use are formed from ordinary cloth without openings but on a warm day they often feel hot enough so that the user is quite uncomfortable wearing them. Some caps of this kind become uncomfortable for the user after they have been worn for a time. This occurs particularly when the cap includes a rigid or semi-rigid material in its construction. Attempts have been made to provide a cap or hat with a provision for moving one or more parts of the cap to render it more useful. Many of these attempts have not provided a commercially acceptable design that was found to be in demand by the consumer. To be useful, the convertible cap must be comfortable as well as rugged in construction and adapted to be converted easily from one form to another.

A major objective of the present invention is to provide a comfortable baseball style cap which provides excellent air ventilation during hot weather but which can be quickly converted by moving a portion of the cap to provide a sheet of cloth material in the nature of a divider to underlie the mesh portion of the cap during cool or inclement weather. In carrying out the invention it was found that it was desirable to find a way of making both the mesh portion of the cap and the movable divider portion both very soft and comfortable when resting against the head. It is also important, although not utterly critical, to include a provision which allows the main body of the cap and the divider as well to be increased or decreased in size as required to fit heads of different sizes. A further object is a provision on the lower edge of a movable divider member to serve as a comfortable band that will engage the forehead when the divider is deflected to a forward position or to engage the rear of the head when the divider is deflected to a rearward position and to provide comfort for the user when in either position, that is, engaging either the forehead or the rear portion of the head.

In the course of developing the present invention it was found that it is highly desirable to provide a movable sheet of cloth within the cap and to find a way to assure that the divider member will conform automatically to the inner surface of the cap in either one of two positions. I refer to this as a provision for making the movable sheet member self-conforming. The term "self-conforming" herein is used to mean that the movable portion of the cap will have a tendency to automatically conform to the inner surface of the cap when moved to either one of two alternate positions therewithin.

A further objective of the invention is to find a way to provide an adjustment means enabling the cap to adjust to heads of various sizes and at the same time automatically adjusting the size of a movable divider sheet underlying the rear crown portion of the cap so that the crown of the cap as well as the underlying divider sheet both can be adjusted at the same time to a particular head size. A further object is to provide a feature allowing the self-conforming divider to be held in a forward or a rearward position by means of a bi-stable member operatively associated with it to keep the divider member stable in either the forward or the rearward position. In this way the bi-stable member can be used to yieldably bias the divider sheet in either its forward or its rearward position.

These and other more detailed and specific objects of the invention will be apparent in view of the following specification and appended claims which describe but a few of the various forms of the invention by way of example.

THE FIGURES

DETAILED DESCRIPTION OF THE INVENTION

Figure 1:
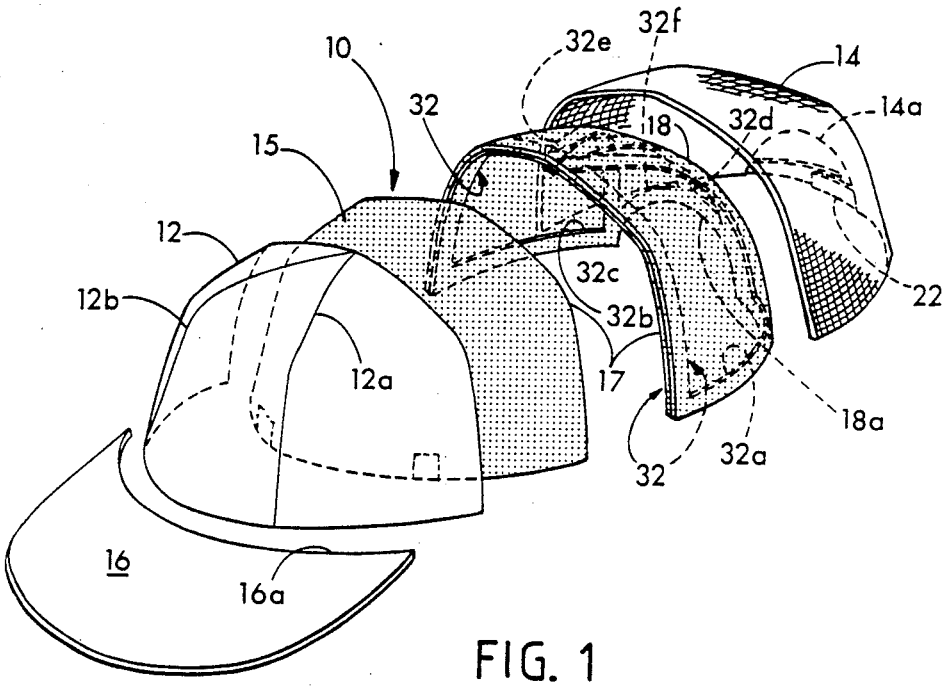
FIG. 1 is an exploded perspective view of a cap embodying the invention.
Figure 2:
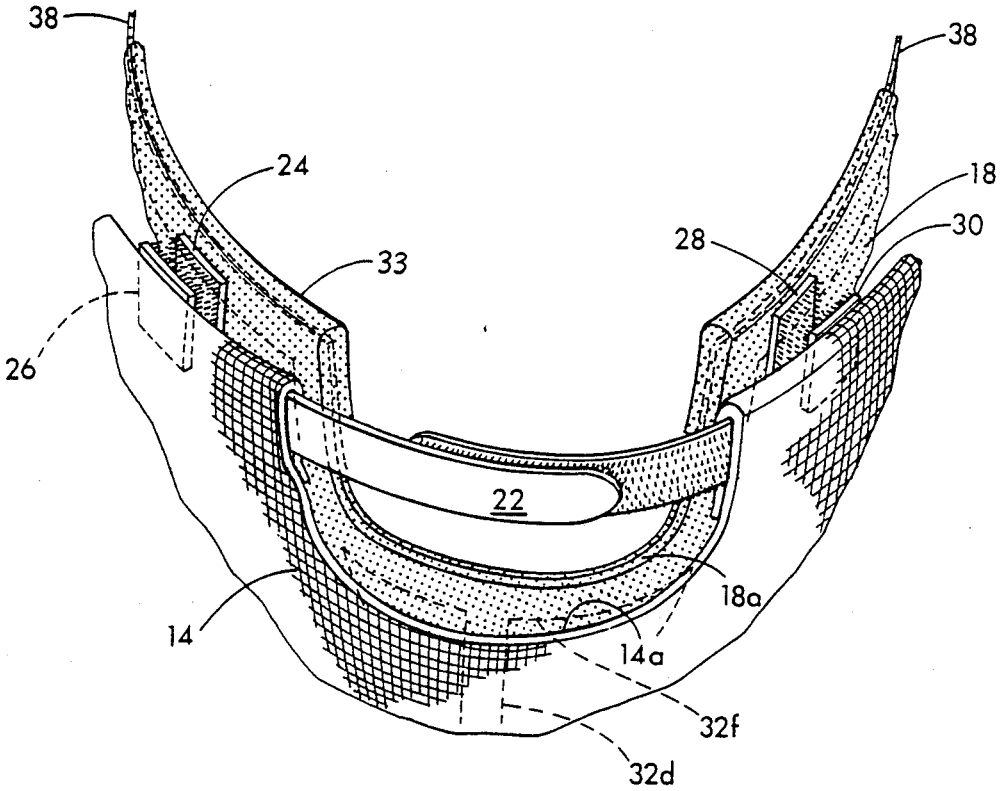
FIG. 2 is a partial perspective view of a cap on a larger scale as seen from below.

Refer now to the figures, and particularly to FIGS. 1 and 2. The cap indicated generally by numeral 10 includes a crown comprised of a front portion 12 composed of cloth and a rear portion 14 composed of soft, flexible open mesh material. The front and rear crown portions 12 and 14 are joined along a transversely extending arcuate seam 17. Within the front portion 12 of the crown can be provided a cloth liner 15 if desired. The forward portion of the crown is preferably provided with arcuate seams **12*a* and 12*b*. To the front of the crown portion 12 is sewn a visor 16 along seam 16*a*. The seams 12*a* and 12*b* can be covered if desired by means of a strip of seam tape (not shown) sewn on either side thereof conventionally to distinction the cap. The open mesh portion 14 can be formed from any suitable open mesh cloth, typically having about 10–15 openings per linear inch. At the rear of the mesh portion 14 is provided a centrally located, downwardly opening upwardly extending cutout portion 14*a*. Extending across the lower edge of the cutout portion 14*a* is an adjustment band 22 in two pieces that contact one another and remain in engagement as seen best in FIG. 2. The adjustment band 22 can be formed from cloth or plastic straps covered with a material which causes them to stick together, such as a hook-and-eye fabric of the type commonly known as Velcro®. The adjustment band 22 allows the crown of the cap 10** to be adjusted to fit heads of various sizes.

Figure 3:
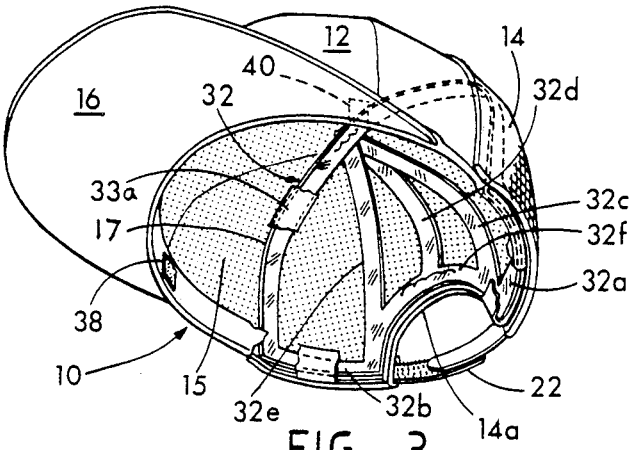
FIG. 3 is a perspective view of the cap as seen from below on the same scale as in FIG. 1.

Secured inside the cap is a sheet of flexible cloth that acts as a movable divider 18. The divider 18 is secured to the inside of the cap along the arcuate transversely extending seam line 17. In this way the divider can be moved by hand between a rearward position (shown in FIGS. 1–3) and a forward position (shown in FIG. 5). Centrally located in the divider within a free lower edge is an upwardly extending, downwardly opening cutout portion 18*a* which coincides in size and shape with the cutout portion 14*a* of the mesh portion 14. As seen in FIGS. 2 and 3, when the divider 18 is deflected to its rearward position the cutout section 18*a* underlies the cutout section 14*a* of the mesh portion 14. In this way, when the adjustment band 22 is manipulated to change the size of the cap the divider 18 is automatically adjusted simultaneously to fit whatever size head is required. If desired, the divider 18 can be held in a rearward position by means of retaining means such as hook-and-eye fasteners 24, 26, 28 and 30 of any suitable type such as Velcro ® or metal snaps, if desired. Similar retaining means 34, 38 and 36, 40 can be provided within the cap to hold the divider 18 in a forward position as shown in FIG. 5.

Figure 5:
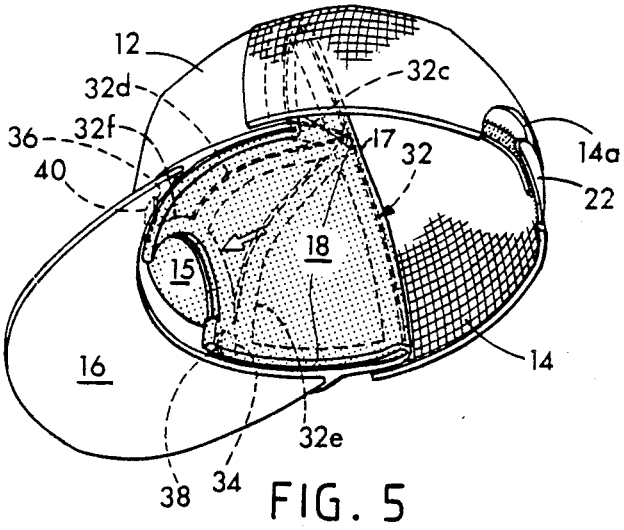
FIG. 5 is a perspective view of the cap seen from below with the divider sheet member deflected to its forward position.

Connected to the cloth divider 18 is a second retaining means 32 comprising a self-supporting piece of sheet material such as a strip of plastic sheet which functions as a bi-stable member for holding the divider in either of the two stable positions, namely the rearward position of FIG. 3 or the forward position of FIG. 5. This causes the divider 18 to be self-conforming to the inside surface of the cap in both positions. The bi-stable member 32 is composed of light, flexible plastic strips sewn to the divider 18 adjacent to the transverse seam line 17 and can also include additional arcuate radially extending ribs 32*c*, 32*d* and 32*e* which at their lower ends are connected to an arcuate section 32*f* that conforms to the edge of the cutout portion 18*a*. Additional strips of plastic 32*a* and 32*b* are enclosed within the lower edge of the divider 18 and specifically within a soft, supple cloth material 33 (FIG. 2) adapted to conform to the head contours to serve as a comfortable band for engagement with the forehead when the divider is deflected to a forward position as well as for engagement with the rear of the head when the divider is deflected to a rearward position in contact with the mesh. In the latter position the divider 18 rests on a portion of the head that would otherwise be exposed through the mesh, thereby protecting the user during cool or inclement weather. The bi-stable retaining member 32, including ribs 32*a*–32*f*, is covered with a seam tape 33*a* (removed for the most part in the drawings so that member 32 can be clearly seen) to provide a soft comfortable surface to engage the head. The bi-stable member 32 including the rib portions 32*a*–32*f* can be formed from a lightweight plastic sheet material such as 20 mil high density polyethylene tetrathalate (PET) or (PET G) or similar plastic resin.

Figure 4:
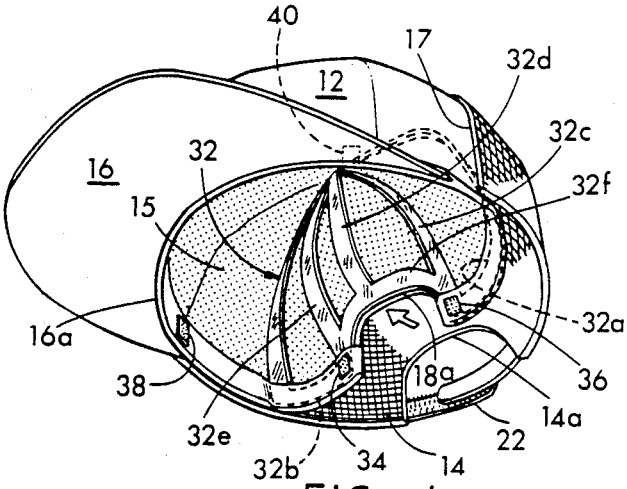
FIG. 4 is a view similar to FIG. 3 showing the divider sheet moved partially from its rearward position toward its forward position.

Assuming that the divider is in its rearward position, the bi-stable member 32 will tend to yieldably bias it in place. It can be moved forward against this internal force by means of light finger pressure as shown in FIG. 4. After the divider sheet 18 crosses the center of the cap, the bi-stable member 32 deflects the divider forwardly with a snapping action. In this way the bi-stable member 32 provides a self-contained snap action for the divider which yieldably biases the divider 18 in either its forward or rearward position so that it is in effect self-conforming to the inside surface of the front or rear of the cap. In this way the bi-stable member 32 functions as a retaining means for releasably holding the divider 18 in its forward or rearward position.

The ribs 32 as well as ribs 32*c*, 32*d* and 32*e* extend radially downward from the center of the crown to the lower headband portion 33. In this way the headband portion 33 of the divider 18 is comfortable for the user whether it is in a forward position against the forehead or in its rearward position. The snap action of the bistable member 32 can be used alone to assist in holding the divider 18 in place within the cap or, if desired, it can also be used with the retaining members 24–30 at the rear or 34–40 at the front of the cap which function as an extra connector means for holding the divider 18 in place at the front or in the rear of the cap conforming to the inside surface of the flexible mesh 14.

In this way the present invention allows for quick and easy manual adjustment when the weather changes to provide excellent cooling during hot weather through the open mesh 14 but provides excellent protection during bad weather or to protect a bald person from the sun by moving the divider 18 to its rearward position.

Many variations of the present invention within the scope of the appended claims will be apparent to those skilled in the art once the principles described herein are understood.

What is claimed is:

1. A convertible cap comprising, a dome-shaped crown having a front portion formed from cloth and a rear portion formed from flexible open-woven mesh to facilitate air transfer through the cap, a visor attached to the crown and extending outwardly therefrom, a movable divider formed from flexible sheet material positioned inside the cap and joined to the inside of the crown along an arcuate transversely extending line of attachment, the divider being adapted to be deflected rearwardly to a position conforming to the inside of the mesh during cool or inclement weather, a pliant headband portion at the lower edge of said divider formed from soft, supple material adapted to conform to the head contours to serve as a comfortable band for engagement with the forehead when the divider is deflected to a forward position and for engagement with the rear of the head when the divider is deflected to a rearward position in contact with the mesh, the divider then resting on a portion of the head that would otherwise be exposed through the mesh.

2. The convertible cap of claim 1 wherein the divider has a centrally located upwardly extending, downwardly opening cutout portion at the center of the headband to facilitate fitting heads of various sizes.

3. The convertible cap of claim 1 wherein the mesh has a lower edge defining a lower rim of the cap and the lower edge of the mesh has a centrally located downwardly opening, upwardly extending cutout portion and an adjustment band on the lower rim portion of the mesh extends across the cutout portion to enable the rim of the mesh portion to be adjusted to various head sizes by lengthening or shortening the adjustment band.

4. The convertible cap of claim 3 wherein the divider has a downwardly opening, centrally located arcuate cutout portion of generally the same size and shape as the cutout portion in the mesh and being adapted to coincide therewith when the divider is deflected to a rearward position in contact with the inside surface of the mesh.

5. The cap of claim 1 wherein retaining means is provided in the cap for releasably holding the divider in one of two positions comprising a rearward position in contact with the mesh and a forward position in contact with the front portion of the crown.

6. The cap of claim 5 wherein the retaining means comprises releasible connector means.

7. The convertible cap of claim 5 wherein the retaining means comprises a deformable snap action, bi-stable member operatively associated with the divider for holding the divider in either a forward or a rearward position.

8. The cap of claim 7 wherein the bi-stable member comprises ribs formed from a self-supporting piece of sheet material, said ribs extending radially downward from the center of the crown to the lower headband portion of the divider, the ribs allowing the divider to be deflected with a snap action to said forward or rearward position.

9. The cap of claim 5 wherein the retaining means comprises a hook-and-eye fabric.

10. The cap of claim 8 wherein the ribs are formed from flat strips of self-supporting plastic sheet material.

11. The cap of claim 1 wherein the mesh is positioned during use to engage the front of the user's head, the cloth portion engages the rear of the user's head and the visor extends forwardly from the crown of the cap.

12. The cap of claim 6 wherein the connector means is provided at both the front and rear of the crown and is selectably engaged with the headband portion of the divider.

* * * * *